US005710581A

United States Patent [19]

Barton et al.

[11] Patent Number: 5,710,581

[45] Date of Patent: Jan. 20, 1998

[54] INKJET PRINTHEAD HAVING INTERMITTENT NOZZLE CLEARING

[75] Inventors: Earl L. Barton, Corvallis, Oreg.; Thomas J. Purwins, Vancouver, Wash.

[73] Assignee: Hewlett-Packard Company, Palo Alto, Calif.

[21] Appl. No.: 283,318

[22] Filed: Jul. 29, 1994

[51] Int. Cl.[6] ..... B41J 2/165

[52] U.S. Cl. ..... 347/35; 347/19

[58] Field of Search ..... 347/23, 19, 35, 347/60, 14

[56] References Cited

U.S. PATENT DOCUMENTS

| | | | |
|---|---|---|---|
| 4,791,434 | 12/1988 | Smith et al. | 347/35 |
| 4,977,459 | 12/1990 | Ebinuma et al. | 358/296 |
| 5,109,234 | 4/1992 | Otis, Jr. et al. | 347/14 |
| 5,185,615 | 2/1993 | Koitabashi et al. | 347/35 |
| 5,187,500 | 2/1993 | Bohorques et al. | 347/56 |
| 5,428,380 | 6/1995 | Ebisawa | 347/19 |

OTHER PUBLICATIONS

Michael T. Dangelo, et al., "Print Cartridge Fixturing and Maintenance in the HP DeskJet 1200 C Printer", Hewlett-Packard Journal, Feb. 1994, vol. 45, No. 1, pp. 67–71.

William S. Colburn et al., "Automated Assembly and Testing of HP DeskJet 1200 C Print Cartridges", Hewlett-Packard Journal, Feb. 1994, vol. 45, No. 1, pp. 79–84.

Hewlett-Packard Company, "HP DeskWriter 560C Users Guide", Manual No. C2169-90010, Dec. 1993, p. 4–11.

Hewlett-Packard Company "HP Deskwriter 560C Setup Guide", Manual No. C2169-90036, Dec. 1993, p. 17.

*Primary Examiner*—John E. Barlow, Jr.

[57] ABSTRACT

A method and apparatus clears blocked nozzles in an inkjet primer printhead by placing the printhead in a position relative to a service station such that ink which is expelled from the nozzles is captured without reaching the medium upon which printing is to occur. Ink is expelled for a first time segment from each nozzle in a first pattern for a number of nozzle expulsions. Following the first time segment, a pause period is entered. Following the pause, ink is expelled in a second time segment from each nozzle in a second pattern for a second number of nozzle expulsions before the printer enters the print status mode.

24 Claims, 6 Drawing Sheets

INKJET PRINTHEAD HAVING INTERMITTENT NOZZLE CLEARING

FIELD OF THE INVENTION

The present invention relates to a printhead for an inkjet printer and more specifically relates to the method and apparatus for clearing blocked nozzles of a printhead employed by a thermal inkjet printer.

BACKGROUND OF THE INVENTION

Thermal inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Expulsion of the ink droplet in a conventional thermal inkjet printer is a result of rapid thermal heating of the ink to a temperature which exceeds the boiling point of the ink solvent and creates a gas phase bubble of ink. Each nozzle is coupled to a small unique firing chamber filled with ink and having an individually addressable heating element resistor in thermal contact with the ink. As the bubble nucleates and expands, it displaces a volume of ink which is forced out of the nozzle and deposited on the medium. The bubble then collapses and the displaced volume of ink is replenished from a larger ink reservoir by way of ink feed channels.

The ink is composed of many chemical constituents, some of which are necessarily volatile for proper drying when the ink droplet is placed on the printed medium. This volatility, however, results in a drying and crusting of ink in and around the nozzle as well as an increased viscosity of the ink in the firing chamber and the associated ink feed channels over a period of time during which the nozzle is not used. To slow the undesired drying of ink, the nozzles are capped during periods of nonuse. Also, as part of a maintenance program for printheads which have not been used for a period of time and for new printheads, the printer is programmed to transport the printhead to a component known as a service station and cause the printhead to spit ink from each nozzle into a spittoon to attempt to clear clogged nozzles and to remove higher viscosity ink from the firing chamber. In some printers, a vacuum system aids in the clearing of nozzles. When a nozzle or its associated ink feed channel becomes plugged or encrusted with dried ink, the amount of ink ejected when a firing pulse is applied to the heater resistor is unpredictable and may be nil. A nozzle ejecting little or no ink produces a noticeable gap in the printed characters or a stripe or band in a solid print path such as might be encountered when a graphics or picture is printed. This gap or band is very undesirable from the standpoint of the user of a printer who expects whole characters and unstriped, solid graphics.

It is well known that ink droplet volume is related, among other things, to the viscosity of the ink. To provide uniformity of droplet volume, the ink is prewarmed in some inkjet printers in the proximity of the nozzles by a series of electrical pulses applied to the resistors which form the ink heating elements. These warming pulses do not contain enough energy to cause the ink to boil (as a firing pulse would) but do provide localized heating to the ink to make the ink viscosity more uniform. This more uniform ink viscosity provides better printing quality by providing a uniformity of ink volume expelled upon the activation of a heater resistor. Such prewarming of ink prior to printing is further discussed in U.S. Pat. No. 5,109,234.

The foregoing efforts to improve the quality of print from an inkjet printhead have resulted in a recognized high quality of performance from the inkjet printhead. Nevertheless, a desire for improved quality of print remains the goal of printhead designers.

SUMMARY OF THE INVENTION

A method and apparatus which clears blocked nozzles in an inkjet printer printhead encompasses the expulsion of ink for a first time segment from a group of nozzles in a first pattern for a number of nozzle expulsions. Following the first time segment, a pause period is entered for a period of time. Ink is expelled in a second time segment following the pause period from the group of nozzles in a second pattern for a second number of nozzle expulsions.

DETAILED DESCRIPTION OF A PREFERRED EMBODIMENT

Figure 1:
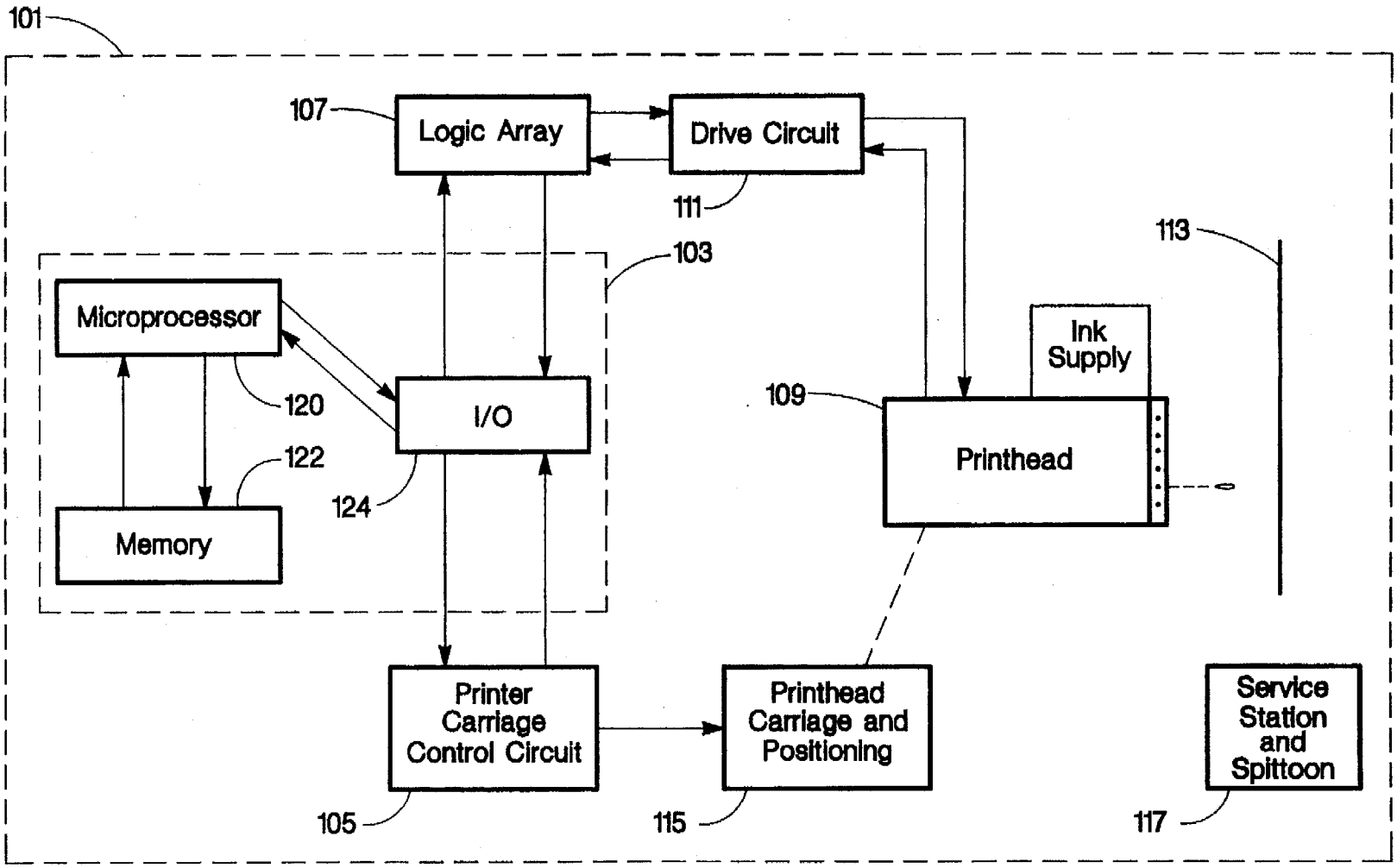
FIG. 1 is a block diagram of an inkjet printer which may employ the present invention.

A basic block diagram of a printer which may employ the present invention is shown in FIG. 1. Such a printer may be a model DeskJet 560C manufactured by Hewlett-Packard Company or similar product. Included in such a printer as that shown in the block diagram as block 101, is an electronic processor 103 which communicates with a conventional printer carriage control circuit 105 and a logic array circuit 107 which controls printhead firing. In a conventional logic array 107, the output from the processor 103 is multiplexed into a reduced number of electrical interconnect lines to the printhead. A print cartridge 109, which may be a model HP 51626A for black ink printing or a model HP 51625A for color printing available from Hewlett-Packard Company or similar print cartridge and suitable for use with the DeskJet 560C printer model, includes and ink supply and an orifice plate. An electronic drive circuit 111 interfaces between the logic array 107 and the printhead 109 and produces a demultiplexed electrical output firing pulse of a predetermined energy to each of the selected thin film heater resistors to boil the ink in a firing chamber and expel the ink from one nozzle. The print cartridge 109 is positioned relative to a medium 113 Upon which characters or objects are to be printed by means of a conventional printhead carriage and positioning function 115.

A service station 117 is used to maintain the cleanliness of the printhead. Typically, the service station 117 is physically located to one side of the medium 113 in the printer and is usually the parking place for the printhead when the printhead is not in use. A capping mechanism, not shown, covers the orifices (nozzles) and maintains a relatively high humidity in the area around the nozzles. Included in the service station is a wiping mechanism which clears debris from the orifice plate without scratching the plate. Also included in the service station is a small reservoir for collecting ink which is expelled during a process of clearing the nozzles of dried ink and other particles. Because of its function, this reservoir has become known as a spittoon.

The processor 103 of the printer of FIG. 1 includes a microprocessor 120 which is a conventional microprocessor device which may also be integrated with additional circuitry in a larger, custom, integrated circuit. Associated ROM memory 122 and interface (I/O) circuitry 124 are included in the processor 103. Stored in the memory 122 are several processes in computer readable form and relating to the operation of the printer. When accessed by the microprocessor 120, these processes are performed in sequence by the microprocessor. In the preferred embodiment, a process of nozzle clearing is generated from the stored commands and executed by the microprocessor 120 through the I/O 124 and the printer carriage and printhead. When the need for clearing nozzles is determined, the print cartridge is positioned in line with the spittoon of the service station 117 and a series of ink droplets are expelled from each nozzle for each color of ink. The need for a clearing of the nozzles, in the preferred embodiment, includes a determination of how long it has been since the nozzles were last fired. If this amount of time exceeds 18 hours, the process of nozzle and ink path clearing is activated. Other nozzle clearing methods may be initiated earlier than 18 hours in an alternative embodiment. Also, if the printer has just been turned on or the print cartridge is a new cartridge, the clearing process is activated. Logic array 107 is a conventional electronic circuit which addresses each nozzle and which controls the firing pulse to each resistor associated with the nozzle.

Figure 2:
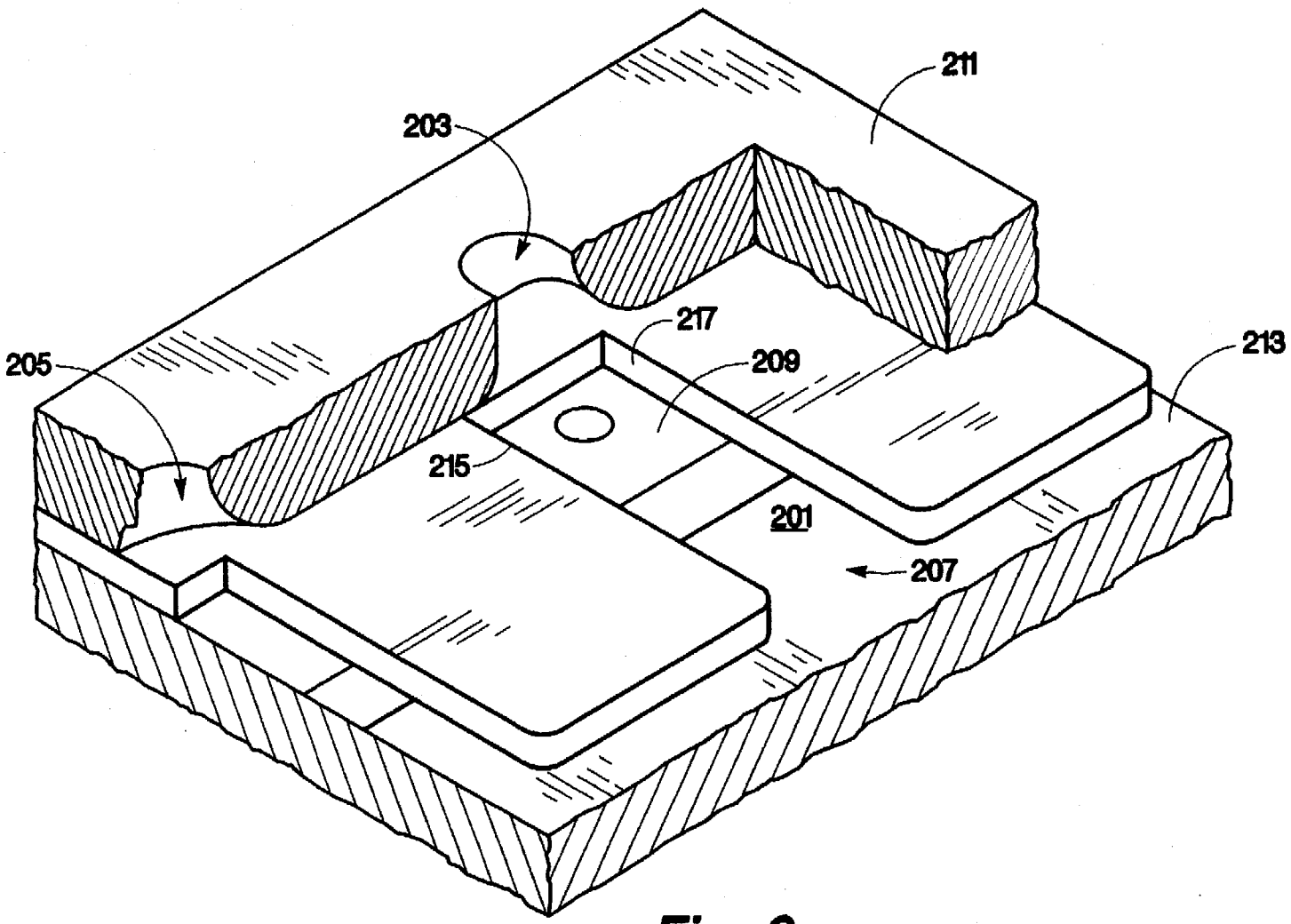
FIG. 2 is an isometric view of a portion of a thermal inkjet printhead for a print cartridge for the printer of FIG. 1.

FIG. 2 is an isometric view of a portion of a typical thermal inkjet printhead illustrating an ink firing chamber 201 and an nozzle (orifice) 203 associated with the ink firing chamber 201. Part of a second nozzle 205 associated with another ink firing chamber is also shown. Many nozzles are typically arranged in a predetermined pattern on the orifice plate so that the ink which is expelled from selected nozzles creates a defined pattern of print on the medium. Ink is supplied to the firing chamber 201 via an opening 207 to replenish ink which has been expelled from nozzle 203 when ink has been vaporized by localized heating from a thin film resistor heating structure 209. The ink firing chamber is bounded by walls created by the orifice plate 211, a layered silicon substrate 213, and walls 215, 217 created by a polymer ink barrier layer. A printhead which would be employed in a printer such as a DeskJet 560C would have 50 nozzles (and associated ink firing chambers and thin film heater resistors) in an orifice plate (and substrate) having approximate dimensions of 5.4 mm by 7.7 mm.

Figure 3:
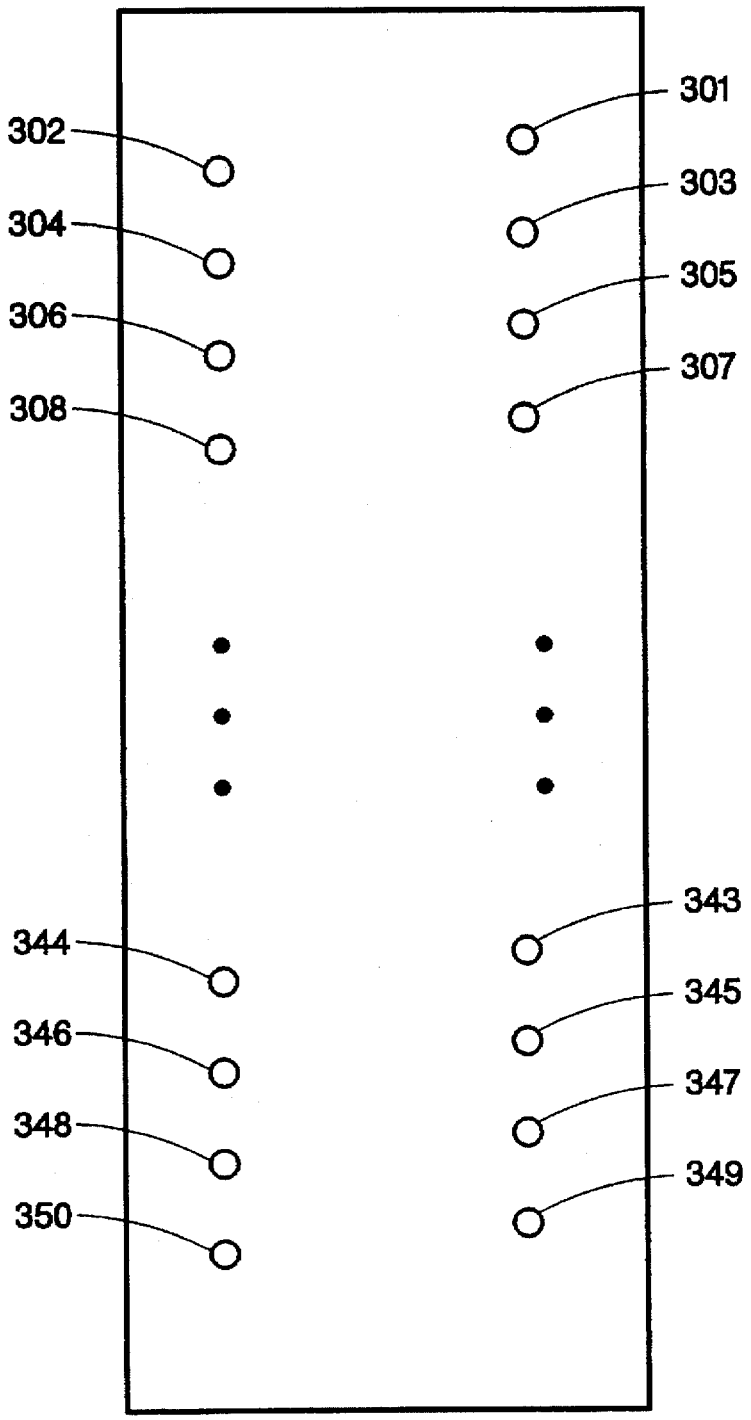
FIG. 3 is a magnified view of a printhead orifice plate which may be used in the print cartridge for the printer of FIG. 1.

A front view of an orifice plate is depicted in FIG. 3. For simplicity, only sixteen nozzles 301–308, 343–350 are shown. Other printheads may have more or fewer nozzles, arrangements of nozzles in other than two columns, and/or nozzle offsets from a straight columnar line. For example, a print cartridge which is capable of multiple color printing may have three groups of two eight nozzle columns for each group, each group being supplied a different color ink from separate ink reservoirs. Nevertheless, each nozzle has a thin film heater resistor which is relatively independently addressable from the logic array and therefore is capable of ejecting ink from the associated nozzle upon command.

Figure 4:
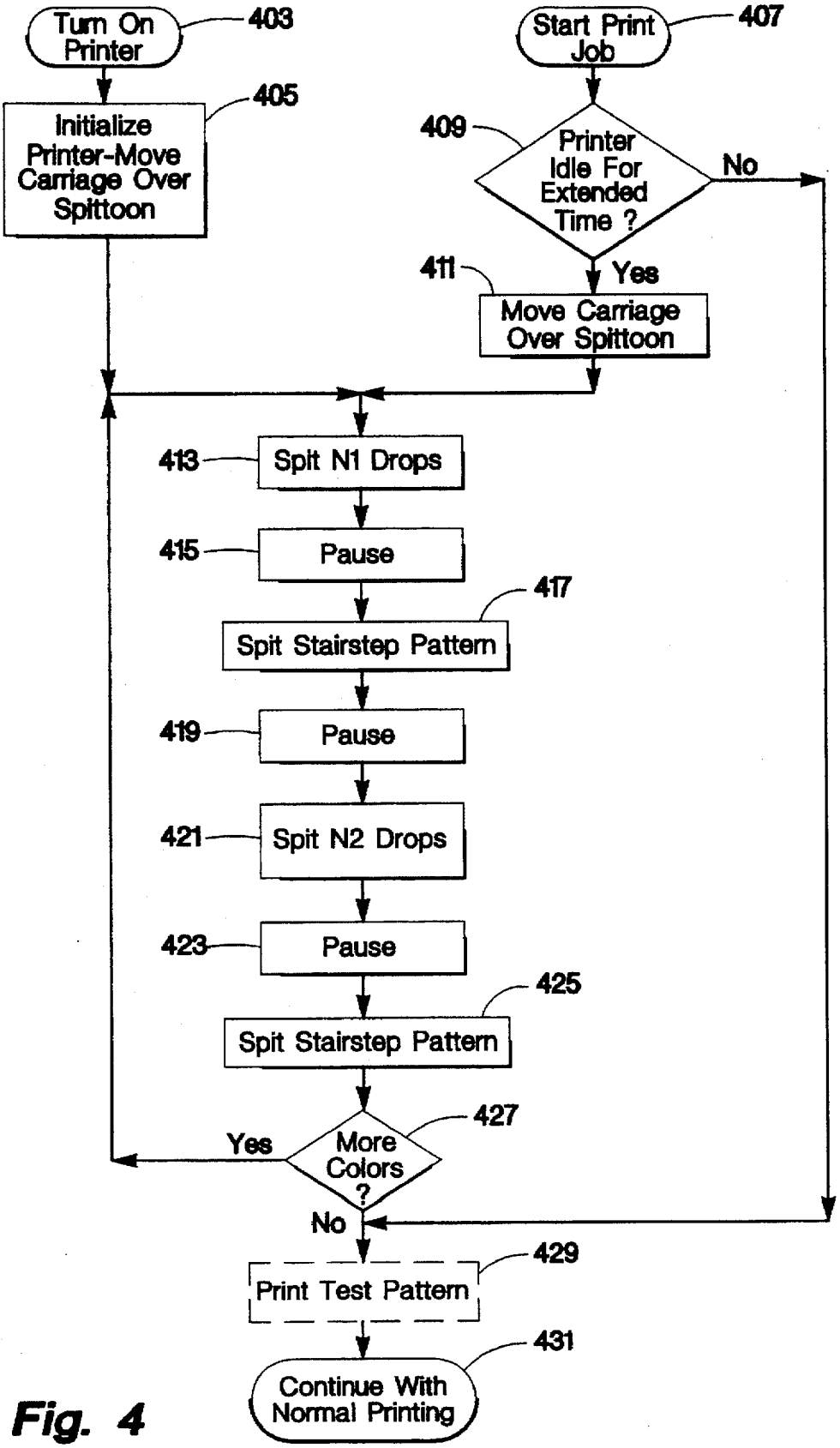
FIG. 4 is a flowchart of the process of pulse spitting from the printhead of the inkjet printer of FIG. 1.

It has been recognized that nozzles can become entrusted with dried ink or plugged with foreign objects and debris such as paper fibers. Furthermore, the ink channels can become blocked with viscous or dried ink as well as foreign objects. Nozzle and ink path clearing is accomplished by a process commonly known as spitting. Conventionally, a printhead is positioned relative to the spittoon such that ink of one color is simultaneously ejected from each nozzle into the spittoon for a number of ejections. This spitting is repeated for each color ink. While this process has proven to be effective, a better process is to discontinuously eject ink from the nozzles. The flowchart of FIG. 4 illustrates the process of intermittent/discontinuous spitting to clear nozzles and ink paths.

Two potential starting points exist for the process of clearing printheads in the preferred embodiment of the present invention. First, when the printer is turned "on" (which in addition to the obvious, also occurs when a new cartridge is inserted into the printer or when the printer is manually commanded to enter a nozzle-clearing mode), at 403, the printer is initialized, at 405, and the carriage containing the printhead is located over the spittoon in anticipation of the ink to be expelled. In the second starting condition, which is upon the start of a print job, at 407, a determination is made whether the printer has been idle for an extended period of time, at 409. In the preferred embodiment, an extended period of time is in the order of 18 hours of non-printing operation. If the extended period of time value has been exceeded, the carriage containing the printhead is positioned over the spittoon, at 411, for the forthcoming expulsion of ink droplets. The logic array 107 is commanded by the microprocessor 120 to spit droplets of ink from each orifice simultaneously $N_i$ times in a first burst, at 413. If the printhead has multicolor capability, only one color of ink is expelled at a single time in the preferred embodiment. However, all the nozzles may spit ink simultaneously regardless of which color ink is associated with a particular group of nozzles in an alternative embodiment. Expulsion of ink is ceased for a pause period of 0.1 seconds, at 415. The microprocessor then commands the logic array to activate the heater resistors of the printhead in a stairstep pattern, at 417, in a manner which causes two printhead nozzles to print simultaneously and sequences to each of a pair of nozzles in turn. Referring again to FIG. 3, the nozzles of the printhead orifice plate are caused to fire in a pattern commencing at opposite ends of the printhead and in opposing columns. That is, starting with nozzles 301 and 350, continuing with nozzles 302 and 349, then nozzles 303 and 348, and so forth until each nozzle has spit twenty ink droplets. Depending upon the number of nozzles and other parameters, the stairstep firing pattern may be repeated one or more times. If the nozzles are arranged in color-associated groups, each group of nozzles fires in the foregoing stairstep pattern. Following the stairstep spiring pattern, the process again pauses, at 419, for a period of time equal to 0.1 seconds. Simultaneous ink expulsion from each nozzle (associated with one ink color) $N_2$ times in a second burst is commanded at 412. A pause of 0.1 seconds is made at 423 and a second stairstep expulsion is made at 425. In the preferred embodiment, $N_1=N_2=300$. Steps 413 through 425 may be repeated as necessary for a given color and this repeat may be sequential or be interdigitated with expulsions of other colors. If the print cartridge contains multiple colors of ink, a determination is made in the preferred embodiment, at 427, that the discontinuous ink spitting process should be performed again for the next color ink. Thus, steps 413 through 425 are repeated for the next ink color until all the ink colors have had the associated nozzles cleared. At the option of the primer, a conventional test pattern may be printed, at 429, upon the medium to enable the user to assess the quality of print following the intermittent printhead clearing process. The printer then proceeds with its normal printing chores, at 431.

Figure 5:
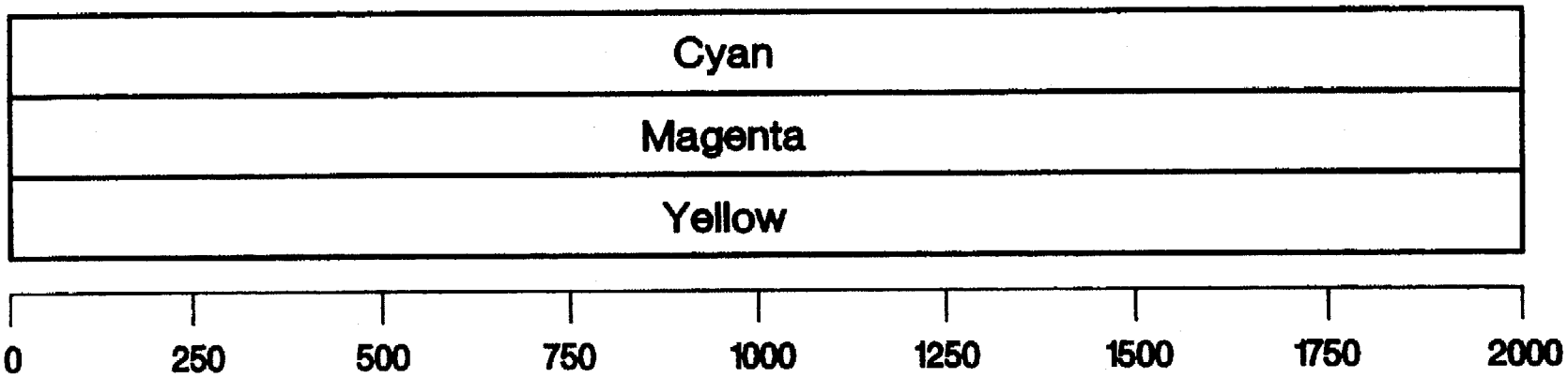
FIG. 5 is a graphic representation of printhead ink output using a conventional spitting nozzle clearing process.

The foregoing process can also be considered as a function of time. A band of printhead ink output using a conventional spitting nozzle clearing process is illustrated in FIG. 5. In a print cartridge which contains three colors of ink, the process of spitting ink droplets occurs for each of three individual groups of nozzles in the printhead. This process can be represented by three bands of color which would be printed upon a medium if the printhead were scanned across the medium at a constant velocity. In practice, the printhead is parked at the service station 117 and the expelled ink droplets are deposited in the spittoon. Shown in FIG. 5 is a graphic representation of three bands of color (cyan, magenta, and yellow) which has an abscissa dimension of the number of expulsions from the nozzles. Conventional printers are known to use 2000 expulsions (of each color) from each nozzle at a continuous rate of droplet expulsion ranging from approximately 3000 to 6000 droplets per second.

Figure 6:
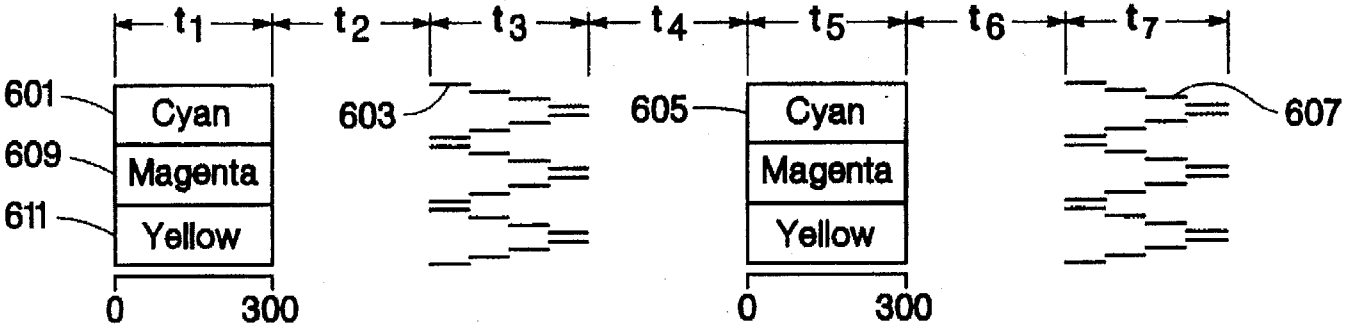
FIG. 6 is a graphic representation of printhead ink output from a printhead spitting nozzle clearing process employing the present invention.

Using the present invention, a similar band of printhead ink output is illustrated in FIG. 6. Again, the abscissa is dimensioned in the number of expulsions (which are related to a time value). It is an important feature of the present invention that the ink droplets are intermittently or discontinuously spit from individual nozzles at particular times to clear the nozzles and associated ink feed and firing chambers. In the preferred embodiment of a multicolor prim cartridge, 300 expulsions of a color are continuously spit at an expulsion rate of 1500 droplets per second over a time segment $t_1=0.2$ second, illustrated as the cyan color burst 601. For a period of time ($t_2=0.1$ second) the printhead pauses from droplet expulsion. A stairstep ink expulsion 603 over a time segment of $t_3=0.11$ second from the cyan color nozzle group follows the pause time $t_2$ during which two nozzles from alternate columns of nozzles from opposite ends of the printhead are fired at a rate of 1500 droplets per second in the sequence described in relation to the flowchart of FIG. 4. This process causes each nozzle to spit twenty times in succession and forces a time delay between the expulsion of ink from adjacent nozzles. Following the stairstep expulsion 603, a second pause time $t_4$ (which in the preferred embodiment is 0.1 second) is observed before a second burst, 605, of 300 expulsions of cyan color at an expulsion rate of 1500 droplets per second for a time segment of $t_5=0.11$ second is performed. A third pause time ($t_6=0.1$ seconds) and a third stairstep expulsion 607, like stairstep expulsion 603, follows the second burst 605 for a time segment of $t_7=0.11$ second.

The foregoing process is then repeated for the magenta colored ink, commencing with a 300 expulsion burst at 609 and then repeated for the yellow colored ink, commencing at 611. An alternative embodiment of the present invention causes the corresponding nozzles of each color to eject ink simultaneously with its corresponding nozzle of each other color of ink. Not shown is a repeating of the entire process starting with the cyan burst. Such a repeat may be performed as needed.

Figure 7:
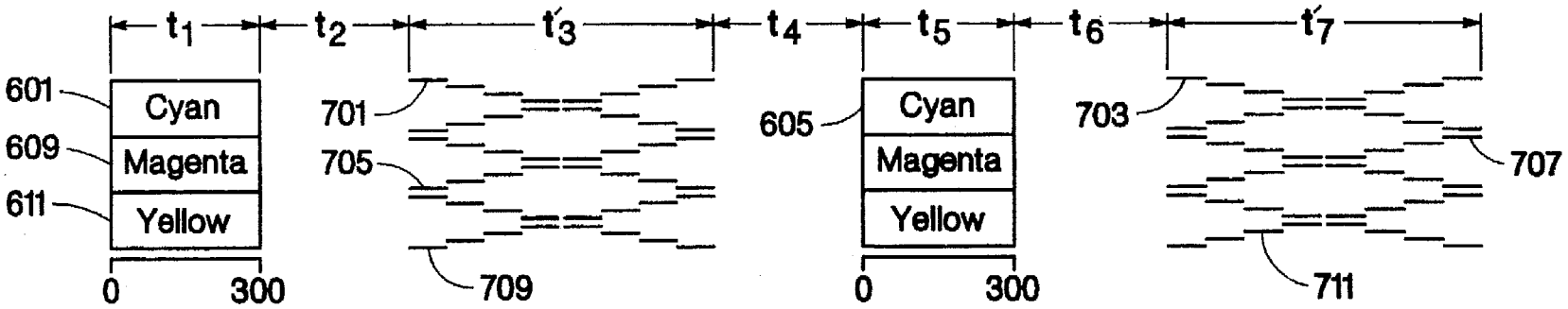
FIG. 7 is a graphic representation of printhead ink output from a printhead employing an alternative nozzle clearing process of the present invention.

An alternative embodiment of the discontinuous spitting to clear blocked nozzles is illustrated in FIG. 7. The continuous droplet bursts described with relation to FIG. 6 (bursts 601, 605, 609, and 611) are performed in the same sequence as described previously. The pause time between bursts likewise are similar to the previously described times. The two stairstep expulsions, 701 and 703, for cyan ink; 705 and 707, for magenta ink; and 709 and 711, for yellow ink are expelled in a different pattern than described previously. Alternate column nozzles at opposite ends of the printhead are fired two at a time in sequence, as they were in the stairstep expulsion 603, but each nozzle droplet firing event occurs twice during the stairstep expulsion time segment $t_3'$ for a total of 40 spits (20 spits per event) for each nozzle. In the preferred embodiment, $t_3'=t_7=0.21$ second. After each nozzle (of the particular ink color) has fired once, the firing order is reversed. Nozzle firing resumes from the two centered but alternate column nozzles and continues for each nozzle to be fired again for one more pulse of ink to be expelled, ending with the alternate nozzles at opposite ends of the printhead. This process is repeated for magenta colored ink (stairstep expulsions 705 and 707) and for yellow colored ink (stairstep expulsions 709 and 711 ). If necessary, the entire pattern of spitting can be repeated, as necessary, starting with the burst of cyan ink. Although a particular stairstep expulsion pattern is employed in the alternative embodiment, a different or random stairstep expulsion pattern will effectively improve the nozzle clearing process as long as the duty cycle of any particular nozzle during the stairstep expulsion pattern is less than 15 percent of the burst duty cycle of a nozzle.

If the print cartridge is only a single color cartridge (for example, black ink) a single or a few repetitive patterns of discontinuous nozzle and ink channel clearing may be performed as described previously. Regardless of the ink color, it is believed that the nonvolatile ink residuals which form around the nozzle opening are cleared by both the mechanical force of the ink droplet expulsion and the dissolving of the residuals by the circulation of fresh ink in the firing chamber. The time dwell in heating using a discontinuous expulsion process allows the heating of the ink and surrounding printhead assembly to extend further into the structure of the printhead and down the ink feed channel from the heater resistor. Such a greater heat spreading further improves the viscosity of the ink and improves the ability of the warmed fluid ink to dissolve dried ink residuals in the ink feed channels. When a continuous firing process is used, however, the ink in the firing chamber is boiled and expelled, thereby carrying a significant portion of the heat energy away with the expelled ink droplet. This results in less heat spreading within the printhead structure and less removal of ink residuals.

We claim:

1. A method of clearing blocked nozzles in an inkjet printer printhead having a mechanism for expelling ink from nozzles, the method comprising, without interruption or manual intervention, the steps of:

(a) expelling ink in a first time segment from the printhead nozzles in a first pattern of nozzle expulsions for a first number of nozzle expulsions;

(b) pausing from ink expulsion for a period of time immediately following said first time segment, said period of time being equal to or less than said first time segment; and (c) expelling ink in a second time segment from the printhead nozzles in a second pattern of nozzle expulsions for a second number of nozzle expulsions immediately following said pausing step, each printhead nozzle expelling ink at least once during said second time segment, such expelling of ink in a second time segment further comprising the step of sequentially expelling ink from each printhead nozzle of predetermined nozzles of the printhead nozzles as said second pattern of nozzle expulsions at a duty cycle of no more than 15 percent of that of said expulsion of ink in a first time segment for a first number of nozzle expulsions.

2. A method in accordance with the method of claim 1 wherein said step of (a) expelling ink in said first time segment further comprises the step of simultaneously expelling ink from each printhead nozzle in repetitive bursts for the full duration of said first time segment as said first pattern of nozzle expulsions.

3. A method in accordance with the method of claim 1 further comprising the step of placing the printhead in a position whereby ink which is expelled from the nozzles is captured without reaching the medium upon which printing is to occur.

4. A method in accordance with the method of claim 1 further comprising the step of entering a print status mode after said ink is expelled in said second time segment.

5. A method in accordance with the method of claim 1 wherein step (c) further comprises the step of expelling ink from at least two predetermined groups of printhead nozzles in said second pattern.

6. A method in accordance with the method of claim 5 wherein said step of expelling ink from at least two predetermined groups of printhead nozzles further comprises the step of sequentially expelling ink from corresponding nozzles of each of said at least two predetermined groups of printhead nozzles.

7. A method in accordance with the method of claim 1 further comprising the step of repeating steps (a) to (c).

8. A method in accordance with the method of claim 1 further comprising the step of printing a test pattern on the medium following step (c).

9. An inkjet printer which expels ink droplets onto a medium from an ink reservoir and which intermittently clears plugged nozzles, comprising:

a printhead which has a plurality of nozzles disposed in an orifice plate:

a plurality of ink ejection chambers fluidically coupled to the ink reservoir and each said ink ejection chamber coupled to a respective one nozzle of said plurality of nozzles;

a plurality of ink ejectors, at least one of said ink ejectors disposed in each of said plurality of ink ejection chambers;

a microprocessor, coupled to said plurality of ink ejectors, which commands said plurality of ink ejectors in sequence to expel ink in a first time segment from said plurality of nozzles in a first pattern of nozzle expulsions for a first number of nozzle expulsions, said first pattern of nozzle expulsions further including a simultaneous expulsion from each printhead nozzle in repetitive bursts for the duration of said first time segment at a duty cycle of no more than 15 percent of that of said expulsion of ink in a second time segment for a second number of nozzle expulsions;

pause from ink expulsion for a period of time immediately following said first time segment, said period of time being equal to or less than said first time segment; and expel ink in a second time segment from said plurality of nozzles in a second pattern of nozzle expulsions for a second number of nozzle expulsions immediately following said pause, each printhead nozzle expelling ink at least once during said second time segment.

10. An inkjet printer having a printhead with a mechanism for expelling ink from nozzles and an apparatus for clearing blocked nozzles, the printer comprising:

means for expelling ink in a first time segment from the printhead nozzles in a first pattern of nozzle expulsions for a first number of nozzle expulsions including means for sequentially expelling ink from predetermined nozzles of the printhead nozzles as said first pattern of nozzle expulsions at a duty cycle of no more than 15 percent of that of said expulsion of ink in a second time segment for a second number of nozzle expulsions;

means for pausing from ink expulsion for a period of time immediately following said first time segment, said period of time being equal to or less than said first time segments; and means for expelling ink in a second time segment from the printhead nozzles in a second pattern of nozzle expulsions for a second number of nozzle expulsions immediately following said pause each printhead nozzle expelling ink at least once during said second time segment.

11. An inkjet printer in accordance with claim 10 further comprising means for expelling ink from at least two predetermined groups of printhead nozzles in said first pattern.

12. An inkjet printer in accordance with claim 11 wherein said means for expelling ink from at least two predetermined groups of printhead nozzles further comprises means for sequentially expelling ink from corresponding nozzles of each of said at least two predetermined groups of printhead nozzles.

13. A method of clearing blocked nozzles in an inkjet printer printhead having a mechanism for expelling ink from nozzles, the method comprising, without interruption or manual intervention, the steps of:

(a) expelling ink in a first time segment from the printhead nozzles in a first pattern of nozzle expulsions for a first number of nozzle expulsions, said step of expelling ink in said first time segment including the step of sequentially expelling in from predetermined nozzles of the printhead nozzles as said first pattern of nozzle expulsions at a duty cycle of no more than 15 percent of that of said expulsion of ink in a second time segment for a second number of nozzle expulsions;

(b) pausing from ink expulsion for a period of time immediately following said first time segment, said period of time being equal to or less than said first time segment; and (c) expelling ink in a second time segment from the printhead nozzles in a second pattern of nozzle expulsions for a second number of nozzle expulsions immediately following said pausing step, each printhead nozzle expelling ink at least once during said second time segment.

14. A method in accordance with the method of claim 13 wherein step (a) further comprises the step of expelling ink from at least two predetermined groups of printhead nozzles in said first pattern.

15. A method in accordance with the method of claim 14 wherein said step of expelling ink from at least two predetermined groups of printhead nozzles further comprises the step of sequentially expelling ink from corresponding nozzles of each of said at least two predetermined groups of printhead nozzles.

16. An inkjet printer which expels ink droplets onto a medium from an ink reservoir and which intermittently clears plugged nozzles, comprising:

a printhead which has a plurality of nozzles disposed in an orifice plate;

a plurality of ink ejection chambers fluidically coupled to the ink reservoir and each said ink ejection chamber coupled to a respective one nozzle of said plurality of nozzles;

a plurality of ink ejectors, at least one of said ink ejectors disposed in each of said plurality of ink ejection chambers; and a microprocessor, coupled to said plurality of ink ejectors, which commands said plurality of ink ejectors in sequence to:

expel ink in a first time segment from said plurality of nozzles in a first pattern of nozzle expulsions for a first number of nozzle expulsions, pause from ink expulsion for a period of time immediately following said first time segment, said period of time being equal to or less than said first time segment; and expel ink in a second time segment from said plurality of nozzles in a second pattern of nozzle expulsions for a second number of nozzle expulsions immediately following said pause, each printhead nozzle expelling ink at least once during said second time segment, said expulsion of ink in a second time segment including the sequential expulsion of ink from predetermined nozzles of the printhead nozzles as said second pattern of nozzle expulsions at a duty cycle of no more than 15 percent of that of said expulsion of ink in a first time segment for a first number of nozzle expulsions.

17. An inkjet printer in accordance with claim 16 wherein said second pattern of nozzle expulsions further comprises a sequential expulsion from predetermined nozzles.

18. An inkjet printer in accordance with claim 16 further comprising a service station whereby ink which is expelled from the nozzles is captured without reaching the medium upon which priming is to occur.

19. An inkjet printer having a printhead with a mechanism for expelling ink from nozzles and an apparatus for clearing blocked nozzles, the printer comprising:

means for expelling ink in a first time segment from the printhead nozzles in a first pattern of nozzle expulsions for a first number of nozzle expulsions;

means for pausing from ink expulsion for a period of time immediately following said first time segment, said period of time being equal to or less than said first time segment; and means for expelling ink in a second time segment from the printhead nozzles in a second pattern of nozzle expulsions for a second number of nozzle expulsions immediately following said pause each printhead nozzle expelling ink at least once during said second time segment, said means for expelling ink in said second time segment further comprising means for sequentially expelling ink from predetermined nozzles of the printhead nozzle as said second pattern of nozzle expulsions at a duty cycle of no more than 15 percent of that of said expulsion of ink in a first time segment for said first number of nozzle expulsions.

20. An inkjet printer in accordance with claim 19 wherein said means for expelling ink in said second time segment further comprises means for simultaneously expelling ink from each printhead nozzle as said second pattern of nozzle expulsions.

21. An inkjet printer in accordance with claim 19 wherein said means for expelling ink in said first time segment further comprises means for simultaneously expelling ink from each printhead nozzle in repetitive bursts for the duration of said first time segment as said first pattern of nozzle expulsions.

22. An inkjet printer in accordance with claim 9 further comprises means for placing the printhead in a position whereby ink which is expelled from the nozzles is captured without reaching the medium upon which printing is to occur.

23. An inkjet printer in accordance with claim 19 further comprises means for expelling ink from at least two predetermined groups of printhead nozzles in said second pattern.

24. An inkjet printer in accordance with claim 23 wherein said means for expelling ink from at least two predetermined groups of printhead nozzles further comprises means for sequentially expelling ink from corresponding nozzles of each of said at least two predetermined groups of printhead nozzles.

* * * * *

UNITED STATES PATENT AND TRADEMARK OFFICE

CERTIFICATE OF CORRECTION

PATENT NO. : 5,710,581
DATED : January 20, 1998
INVENTOR(S) : Barton et al.

It is certified that error appears in the above-identified patent and that said Letters Patent is hereby corrected as shown below:

Column 9,
Line 45, delete “priming” and insert therefor -- printing --.

Column 10,
Line 33, delete “9” and insert therefor -- 19 --.

Signed and Sealed this

Twenty-first Day of October, 2003

JAMES E. ROGAN
*Director of the United States Patent and Trademark Office*